US011712692B2

(12) United States Patent
Williams et al.

(10) Patent No.: US 11,712,692 B2
(45) Date of Patent: Aug. 1, 2023

(54) SAMPLE COLLECTION SYSTEM INCLUDING SEALING CAP AND VALVE

(71) Applicant: SPECTRUM SOLUTIONS, L.L.C., Draper, UT (US)

(72) Inventors: Kevin Gregg Williams, Draper, UT (US); Neil Jeremy Johnson, Riverton, UT (US)

(73) Assignee: Spectrum Solutions L.L.C., Draper, UT (US)

( * ) Notice: Subject to any disclaimer, the term of this patent is extended or adjusted under 35 U.S.C. 154(b) by 410 days.

(21) Appl. No.: 16/689,538

(22) Filed: Nov. 20, 2019

(65) Prior Publication Data

US 2020/0156056 A1 May 21, 2020

Related U.S. Application Data

(60) Provisional application No. 62/769,740, filed on Nov. 20, 2018.

(51) Int. Cl.
*B01L 3/00* (2006.01)

(52) U.S. Cl.
CPC ..... *B01L 3/502* (2013.01); *B01L 2200/0689* (2013.01); *B01L 2200/16* (2013.01);
(Continued)

(58) Field of Classification Search
CPC ..... B01L 3/502; B01L 2200/0689; B01L 2200/16; B01L 2300/042;
(Continued)

(56) References Cited

U.S. PATENT DOCUMENTS 2,275,567 A 3/1942 Smith
2,631,521 A 3/1953 Atkins, Jr.
(Continued)

FOREIGN PATENT DOCUMENTS

AU 2013206564 A1 7/2013
CA 2072331 A1 12/1992
(Continued)

OTHER PUBLICATIONS

International Search Report and Written Opinion issued in PCT/US19/62484 dated Jan. 29, 2020.
(Continued)

*Primary Examiner* — Benjamin R Whatley
*Assistant Examiner* — Jacqueline Brazin
(74) *Attorney, Agent, or Firm* — Workman Nydegger

(57) ABSTRACT

A biological sample collection system can include a sample collection vessel having an opening configured to receive a biological sample and a selectively movable valve configured to at least partially associate with the opening of the sample collection vessel. The selectively movable valve can include a post and a valve head associated with a distal portion of the post. The system can additionally include a sealing cap configured to associate with the selectively movable valve and with the sample collection vessel. The sealing cap can include a reagent chamber for storing a measure of sample preservation reagent and associating the sealing cap with the sample collection vessel causes a physical rearrangement of the post and the valve head such that a fluid vent associated with the post aligns with an aperture defined by the valve head allowing fluid communication between the reagent chamber and the sample collection vessel.

22 Claims, 3 Drawing Sheets

(52) U.S. Cl.
CPC . *B01L 2300/042* (2013.01); *B01L 2300/0832* (2013.01); *B01L 2400/06* (2013.01)

(58) Field of Classification Search
CPC ..... B01L 2300/0832; B01L 2400/06; B01L 2300/048; B01L 2300/049; B01L 3/50825; B01L 2200/0684
USPC ..... 422/540
See application file for complete search history.

(56) References Cited

U.S. PATENT DOCUMENTS 2,653,611 A 9/1953 Smith
2,764,983 A 10/1956 Pius et al.
2,773,591 A 12/1956 Jensen
3,321,097 A 5/1967 Solowey
3,340,873 A 9/1967 Solowey
3,347,410 A 10/1967 Schwartzman
3,441,179 A 4/1969 Ragan
3,464,414 A 9/1969 Sponnoble
3,518,164 A 6/1970 Andelin et al.
3,536,191 A 10/1970 Williams
3,537,606 A 11/1970 Solowey
3,603,484 A 9/1971 Ogle
3,651,990 A 3/1972 Cernei
3,670,914 A 6/1972 Poulsen, Jr.
3,674,028 A 7/1972 Ogle
3,684,455 A 8/1972 Vacirca et al.
3,731,853 A 5/1973 Beham et al.
3,792,699 A 2/1974 Tobin et al.
3,846,077 A 11/1974 Ohringer
3,878,571 A 4/1975 Seeley
3,924,741 A 12/1975 Kachur et al.
3,968,872 A 7/1976 Cavazza
4,102,451 A 7/1978 Clarke et al.
4,150,950 A 4/1979 Takeguchi et al.
4,195,730 A 4/1980 Hunt
4,221,291 A 9/1980 Hunt
4,311,792 A 1/1982 Avery
4,324,859 A 4/1982 Saxholm
4,418,702 A 12/1983 Brown et al.
4,465,183 A 8/1984 Saito et al.
4,473,530 A 9/1984 Villa-Real
4,589,548 A 5/1986 Fay
4,591,050 A 5/1986 Finke et al.
4,615,437 A 10/1986 Finke et al.
4,634,003 A 1/1987 Ueda et al.
4,727,985 A 3/1988 McNeirney et al.
4,741,346 A 5/1988 Wong et al.
4,761,379 A 8/1988 Williams et al.
4,920,975 A 5/1990 Fay
4,932,081 A 6/1990 Burns
4,982,875 A 1/1991 Pozzi et al.
5,029,718 A 7/1991 Rizzardi
5,119,830 A 6/1992 Davis
5,128,104 A 7/1992 Murphy et al.
5,152,965 A 10/1992 Fisk et al.
5,266,266 A 11/1993 Nason
5,268,148 A 12/1993 Seymour
5,291,991 A 3/1994 Meyer
5,330,048 A 7/1994 Haber et al.
5,335,673 A 8/1994 Goldstein et al.
5,422,241 A 6/1995 Goldrick et al.
5,425,921 A 6/1995 Coakley et al.
5,445,965 A * 8/1995 Stone ..... B01L 3/502 436/77
5,478,722 A 12/1995 Caldwell
5,490,971 A 2/1996 Gifford et al.
5,494,646 A 2/1996 Seymour
5,643,767 A 7/1997 Fischetti et al.
5,658,531 A 8/1997 Cope et al.
5,714,380 A * 2/1998 Neri ..... B01L 3/502 422/504
5,786,228 A 7/1998 Charlton
5,827,675 A 10/1998 Skiffington et al.
5,869,328 A 2/1999 Antoci et al.
5,921,396 A 7/1999 Brown, Jr.
5,927,549 A 7/1999 Wood
5,935,864 A 8/1999 Schramm et al.
5,941,380 A 8/1999 Rothman
5,950,819 A 9/1999 Sellars
5,967,309 A 10/1999 Robles-Gonzalez et al.
5,968,746 A 10/1999 Schneider
5,973,137 A 10/1999 Heath
5,976,829 A 11/1999 Birnboim
5,984,141 A 11/1999 Gibler
6,003,728 A 12/1999 Elliott
6,113,257 A 9/2000 Sharon et al.
6,121,055 A 9/2000 Hargreaves
6,138,821 A 10/2000 Hsu
6,148,996 A 11/2000 Morini
6,149,866 A 11/2000 Luotola et al.
6,204,375 B1 3/2001 Lader
6,224,922 B1 5/2001 Fonte
6,228,323 B1 5/2001 Asgharian et al.
6,277,646 B1 8/2001 Guirguis et al.
6,309,827 B1 10/2001 Goldstein et al.
6,503,716 B1 1/2003 Lai et al.
6,524,530 B1 2/2003 Igarashi et al.
6,527,110 B2 3/2003 Moscovitz
6,528,641 B2 3/2003 Lader
6,533,113 B2 3/2003 Moscovitz
6,617,170 B2 9/2003 Augello et al.
6,776,959 B1 8/2004 Helftenbein
7,282,371 B2 10/2007 Helftenbein
7,464,811 B2 12/2008 Patterson et al.
7,482,116 B2 1/2009 Birnboim
7,748,550 B2 7/2010 Cho
8,084,443 B2 12/2011 Fischer et al.
8,137,958 B2 3/2012 Grimes et al.
8,293,467 B2 10/2012 Fischer et al.
8,415,330 B2 4/2013 Fischer et al.
8,418,865 B2 4/2013 Cho
8,669,240 B2 3/2014 Fischer et al.
8,728,414 B2 5/2014 Beach et al.
9,079,181 B2 7/2015 Curry et al.
9,138,747 B2 9/2015 Williams et al.
9,212,399 B2 12/2015 Fischer et al.
9,370,775 B2 6/2016 Harvey et al.
9,442,046 B2 9/2016 Biadillah et al.
9,523,115 B2 12/2016 Birnboim
9,683,256 B2 6/2017 Fischer et al.
9,732,376 B2 8/2017 Oyler et al.
10,000,795 B2 6/2018 Birnboim et al.
10,174,362 B2 1/2019 Gaeta
10,189,020 B2 1/2019 Williams et al.
10,525,473 B2 1/2020 Williams
10,576,468 B2 3/2020 Biadillah et al.
10,619,187 B2 4/2020 Birnboim
10,767,215 B2 9/2020 Birnboim et al.
10,774,368 B2 9/2020 Gaeta
11,002,646 B2 5/2021 Biadillah et al.
2001/0023072 A1 9/2001 Crawford et al.
2001/0031473 A1 10/2001 Dattagupta et al.
2002/0110810 A1 8/2002 Shuber
2002/0197631 A1 12/2002 Lawrence et al.
2003/0114430 A1 6/2003 MacLeod et al.
2003/0132244 A1 7/2003 Birkmayer et al.
2003/0143752 A1 7/2003 Feldsine et al.
2004/0014237 A1 1/2004 Sugiyama et al.
2004/0038269 A1 2/2004 Birnboim
2004/0038424 A1 2/2004 Maples
2004/0101859 A1 5/2004 Moon et al.
2004/0161788 A1 8/2004 Chen et al.
2004/0200740 A1 10/2004 Cho
2004/0200741 A1 10/2004 Cho
2004/0237674 A1 12/2004 Wu et al.
2005/0079484 A1 4/2005 Heineman et al.
2005/0101920 A1 5/2005 Keane et al.
2005/0112024 A1 5/2005 Guo et al.
2005/0123928 A1 6/2005 Das et al.
2006/0216196 A1 9/2006 Satoh et al.
2006/0245977 A1 11/2006 Bodner
2006/0260959 A1 11/2006 Patterson et al.

(56) References Cited

U.S. PATENT DOCUMENTS

| | | | | |
|---|---|---|---|---|
| 2007/0072229 | A1 | 3/2007 | Bialozynski et al. | |
| 2007/0134134 | A1 | 6/2007 | Watts et al. | |
| 2007/0140915 | A1 | 6/2007 | Sakal et al. | |
| 2007/0202511 | A1 | 8/2007 | Chen et al. | |
| 2007/0280042 | A1 | 12/2007 | Yamanaka | |
| 2007/0287149 | A1 | 12/2007 | Shomi et al. | |
| 2008/0003574 | A1 | 1/2008 | Michalik et al. | |
| 2008/0067084 | A1 | 3/2008 | Patterson et al. | |
| 2008/0156674 | A1 | 7/2008 | Correale et al. | |
| 2008/0187924 | A1 | 8/2008 | Korfhage et al. | |
| 2008/0194986 | A1 | 8/2008 | Conway | |
| 2008/0226506 | A1 | 9/2008 | Ohashi | |
| 2008/0260581 | A1 | 10/2008 | Rosman et al. | |
| 2008/0293156 | A1 | 11/2008 | Smith | |
| 2009/0022631 | A1 | 1/2009 | Ohashi et al. | |
| 2009/0023219 | A1 | 1/2009 | Perez | |
| 2009/0133366 | A1* | 5/2009 | Cronin | B65D 51/2892 53/420 |
| 2009/0216213 | A1 | 8/2009 | Muir et al. | |
| 2009/0312285 | A1 | 12/2009 | Fischer et al. | |
| 2011/0068102 | A1 | 3/2011 | Porter | |
| 2011/0212002 | A1 | 9/2011 | Curry et al. | |
| 2012/0046574 | A1 | 2/2012 | Skakoon | |
| 2012/0220043 | A1 | 8/2012 | Sangha | |
| 2012/0308448 | A1 | 12/2012 | Wong | |
| 2012/0325721 | A1 | 12/2012 | Plante et al. | |
| 2013/0011311 | A1 | 1/2013 | Kim | |
| 2013/0026691 | A1 | 1/2013 | Cahill et al. | |
| 2013/0209993 | A1 | 8/2013 | Aronowitz | |
| 2013/0248045 | A1 | 9/2013 | Williams et al. | |
| 2014/0051178 | A1 | 2/2014 | Niggel et al. | |
| 2014/0120531 | A1* | 5/2014 | Biadillah | A61B 10/007 435/7.1 |
| 2015/0056716 | A1 | 2/2015 | Oyler et al. | |
| 2015/0140681 | A1 | 5/2015 | Meng et al. | |
| 2015/0190122 | A1 | 7/2015 | Butlin et al. | |
| 2015/0203258 | A1* | 7/2015 | Staton | B01L 3/567 220/371 |
| 2015/0289856 | A1 | 10/2015 | Saqi et al. | |
| 2015/0343438 | A1 | 12/2015 | Williams et al. | |
| 2016/0023210 | A1 | 1/2016 | Birkner et al. | |
| 2016/0045187 | A1* | 2/2016 | Terbrueggen | B01L 1/52 435/6.1 |
| 2016/0296936 | A1* | 10/2016 | Trump | B01L 3/523 |
| 2017/0001191 | A1 | 1/2017 | Biadillah et al. | |
| 2017/0350797 | A1 | 12/2017 | Estep et al. | |
| 2018/0344568 | A1 | 12/2018 | Phillips et al. | |
| 2019/0151842 | A1* | 5/2019 | Williams | B01L 3/523 |
| 2019/0200966 | A1 | 7/2019 | Zhan et al. | |
| 2020/0254460 | A1* | 8/2020 | Blair | A61B 10/0096 |
| 2020/0269232 | A1 | 8/2020 | Williams et al. | |
| 2020/0284704 | A1* | 9/2020 | Biadillah | G01N 1/10 |

FOREIGN PATENT DOCUMENTS

| | | | | |
|---|---|---|---|---|
| CA | 2236240 | A1 | 10/1999 | |
| CA | 2348152 | A1 | 2/2000 | |
| CA | 2488769 | A1 | 12/2003 | |
| DE | 10219117 | C1 | 10/2003 | |
| EP | 0215533 | A2 | 3/1987 | |
| EP | 0215735 | A1 | 3/1987 | |
| EP | 0586024 | A1 | 3/1994 | |
| EP | 0734684 | A1 | 10/1996 | |
| EP | 1513952 | B1 | 12/2010 | |
| GB | 1403274 | A | 8/1975 | |
| JP | 05-187976 | A | 7/1993 | |
| JP | 06-046856 | A | 2/1994 | |
| JP | 09-509495 | A | 9/1997 | |
| JP | 10-273161 | A | 10/1998 | |
| JP | 2000-346838 | A | 12/2000 | |
| JP | 2009-519439 | A | 5/2009 | |
| JP | 2014-527615 | A | 10/2014 | |
| JP | 2017-522550 | A | 8/2017 | |
| WO | 89/06704 | A1 | 7/1989 | |
| WO | 91/02740 | A1 | 3/1991 | |
| WO | 97/05248 | A2 | 2/1997 | |
| WO | 97/48492 | A1 | 12/1997 | |
| WO | 98/03265 | A1 | 1/1998 | |
| WO | 98/04899 | A1 | 2/1998 | |
| WO | 98/38917 | A1 | 9/1998 | |
| WO | 98/44158 | A1 | 10/1998 | |
| WO | 99/29904 | A2 | 6/1999 | |
| WO | 00/06780 | A1 | 2/2000 | |
| WO | 00/10884 | A1 | 3/2000 | |
| WO | 00/77235 | A1 | 12/2000 | |
| WO | 01/34844 | A1 | 5/2001 | |
| WO | 02/88296 | A1 | 11/2002 | |
| WO | 2003/104251 | A2 | 12/2003 | |
| WO | 2004/094635 | A2 | 11/2004 | |
| WO | 2004/104181 | A2 | 12/2004 | |
| WO | 2005/051775 | A2 | 6/2005 | |
| WO | 2005/111210 | A1 | 11/2005 | |
| WO | 2005/120977 | A1 | 12/2005 | |
| WO | WO-2005120977 | A1 * | 12/2005 | B65D 47/243 |
| WO | 2006/096973 | A1 | 9/2006 | |
| WO | 2012/177656 | A2 | 12/2012 | |

OTHER PUBLICATIONS

International Preliminary Reporton Patentability received for PCT Patent Application No. PCT/US2019/062484, dated Jun. 3, 2021, 8 pages.

International Search Report and Written Opinion received for PCT Patent Application No. PCT/US20/038858, dated Sep. 30, 2020, 11 pages.

International Search Report issued in PCT/US2018/030681 dated Jul. 12, 2018.

Office Action issued in U.S. Appl. No. 14/952,712 dated Dec. 15, 2017.

463a. EDTA-MEDIUM, 2010 DSMZ Gmbh.

Ausubel et al. , "Analysis of Protein Interactions", Current Protocols in Molecular Biology, Dec. 4, 2003.

Ausubel et al.,"Preparation and Analysis of RNA" Current Protocols in Molecular Biology, Dec. 4, 2003.

Boom et al., "Rapid and Simple Method for Purification of Nucleic Acids", Journal of Clinical Microbiology, Apr. 1990.

Brady, Chapter 16 Acid-Base Equilibria in Aqueous Solutions, "General Chemistry Principles and Structure Buffers: the control of pH" 1990.

Breslow et al., "On the mechanism of action of ribonuclease A: Relevance of enzymatic studies with a p-nitrophenylphosphate ester and a thiophosphate ester" Proc. Natl. Acad. Sci. USA., vol. 93, pp. 10018-10021, Sep. 1996.

Chirgwin et al. "Isolation of Biologically Active Ribonucleic Acid from Sources Enriched in Ribonuclease", Biochemistry vol. 18, No. 24, 1979.

Cox et al., "The Use of Guanidinium Chloride in the Isolation of Nucleic Acids" Methods in Enzymology, vol. XII, Nucleic Acids, Part B, 1968.

Cunningham et al., "Colorectal Cancer Methods and Protocols" Methods in Molecular Medicine, vol. 50; 2001.

Doosti et al., "Study of the frequency of Clostridium difficile tcdA, tcdB, cdtA and cdtB genes in feces of Calves in south west of Iran" Ann Clin Microbial Antimicrob. Jun. 5, 2014.

Excerpts from the American Heritage Dictionary, 2000.

Farrell, "RNA Methodologies a Laboratory Guide for Solation and Aracterization Chapters 4 and 5" Copyright Elsevier 2021.

Feramisco et al., "Co-existence of Vinculin and a Vinculin-like Protein of Higher Molecular Weight in Smooth Muscle" The Journal of Biological Chemistry, vol. 257, No. 18, Issue of Sep. 25, pp. 11024-11031, 1982.

Fisher Catalog 1998-1999.

Freeman et al., "DNA by Mail: An Inexpensive and Noninvasive Method for Collecting DNA Samples from Widely Dispersed Populations" Behavior Genetics, vol. 27, No. 3 1997.

Garcia-Closas et al., "Collection of Genomic DNA from Adults in Epidemiological Studies by Buccal Cytobrush and Mouthwash" Cancer Epidemiology, Biomarkers and Prevention, vol. 10, 687-696, Jun. 2001.

(56) References Cited

OTHER PUBLICATIONS

Goldenberger et al., "A Simple "Universal" DNA Extraction Procedure Using SOS and Proteinase K Is Compatible with Direct PCR Amplification" PCR Methods and Applications, accepted Mar. 31, 1995.
International Preliminary Report on Patentability received for PCT Patent Application No. PCT/US2020/038858, dated Dec. 30, 2021, 9 pages.
Johnson et al., "Effectiveness of alcohol-based hand rubs for removal of Clostridium difficile spores from hands", Infect Control Hosp Epidemiol, Jun. 2010.
Kilpatrick et al, "Noncryogenic Preservation of Mammalian Tissues for DNA Extraction: An Assessment of Storage Methods" Biochemical Genetics, vol. 40, Nos. ½, Feb. 2002.
Loens et al., "Detection of Mycoplasma pneumoniae in Spiked Clinical Samples by Nucleic Acid Sequence-Based Amplification" Journal of Clinical Microbiology, Apr. 2002, p. 1339-1345.
Longmire et al., "Use of "Lysis Buffer" in DNA Isolation and Its Implication for Museum Collections" Museum of Texas Tech University, No. 163, May 1, 1997.
Maniatis et al., "Isolation of MRNA From Mammalian Cells", 1982.
Maniatis et al., "Molecular Cloning a Laboratory Manual" Cold Spring Harbor Laboratory; 1982.
Meulenbelt et al., "High-Yield Noninvasive Human Genomic DNA Isolation Method for Genetic Studies in Geographically Dispersed Families and Populations" 1995.
Monahan et al., "Extraction of RNA from Intracellular *Mycobacterium tuberculosis*" Methods in Molecular Medicine, vol. 54: *Mycobacterium tuberculosis* Protocols; 2001.
Noll et al., "The Use of Sodium and Lithium Dodecyl Sulfate in Nucleic Acid Isolation" Methods in Enzymology, vol. XII, Nucleic Acids, Part B, 1968.
Piotr Chomczynsk, et al., "Single-Step Method of RNA Isolation by Acid Guanidinium Thiocyanate-Phenol-Chloroform Extraction" Analytical Biochemistry 162, 156-159; 1987.
Promega 1993-1994 Catalog, Revolutions in Science.
Rutala et al., "Guideline for Disinfection and Sterilization in Healthcare Facilities, 2008".
Rymaszewski et al., "Estimation of cellular DNA content in cell lysates suitable for RNA isolation" Analytical Biochemistry, vol. 188, Issue 1, Jul. 1990, pp. 91-96.
Sela et al., "The Correlation of Ribonuclease Activity with Specific Aspects of Tertiary Structure" Biochimica et Biophysica Acta, vol. 26, 1957.
Seutin et al., "Preservation of avian blood and tissue samples for DNA analyses" 1990.
Shahbazi et al., "Screening of SOS-degrading bacteria from car wash wastewater and study of the alkylsulfatase enzyme activity", Iranian Journal of Microbiology, vol. 5 No. 2, Jun. 2013, pp. 153-158.
Spectrum Solutions, "FDA Emergency Use Authorization Granted Utilizing Saliva for COVID-19 Testing Exlcusively Using SDNA-1000Saliva Collection Device from Spectrum" Apr. 13, 2020.
Spectrum Solutions, "Technically Superior Whole Saliva Collection Devices, accessed on Nov. 20, 2020".
Streckfus et al., "Saliva as a diagnostic fluid" 2002.
Tabak et al., "A Revolution in Biomedical Assessment: The Development of Salivary Diagnostics" Journal of Dental Education, Dec. 2001.
Thermo Fisher Scientific, "Top 10 Ways to Improve Your RNA Isolation", Downloaded on or around Nov. 22, 2021.
Vintiloiu et al., "Effect of ethylenediaminetetraacetic acid (EDTA) on the bioavailability of trace elements during anaerobic digestion" Chemical Engineering Journal, vol. 223, May 1, 2013, pp. 436-441.
Woldringh et al., "Effects of Treatment with Sodium Dodecyl Sulfate on the Ultrastructure of *Escherichia coli*" Journal of Bacteriology, Sep. 1972.
Yuan et al., "Statistical Analysis of Real-Time PCR Data" BMC Bioinformatics, Feb. 22, 2006.
Zou, "A Practical Approach to Genetic Screening for Influenza Virus Variants", Journal of Clinical Microbiology, vol. 25, No. 10, Oct. 1997, p. 2623-2627.
European Search Report received for EP Patent Application No. 19887385.3, dated Aug. 8, 2022, 10 pages.
Jennings et al., Petition for Inter Partes Review of Patent No. 11,002,646, Jul. 29, 2022.

* cited by examiner

SAMPLE COLLECTION SYSTEM INCLUDING SEALING CAP AND VALVE

CROSS-REFERENCE TO RELATED APPLICATIONS

This application claims priority to and the benefit of U.S. Provisional Patent Application Ser. No. 62/769,740, filed Nov. 20, 2018 and titled "SAMPLE COLLECTION SYSTEM INCLUDING SEALING CAP AND VALVE," which is incorporated herein by this reference in its entirety.

BACKGROUND

Technical Field

This disclosure generally relates to vials and vessels for collecting and storing biological samples. More specifically, the present disclosure relates to systems and kits for the collection and preservation of biological samples for future testing in a laboratory or other biological sample analysis facility.

Background and Relevant Art

Field collection of biological samples can provide scientists, physicians, geneticist, epidemiologists, or similar personnel with invaluable information. For example, access to a fresh sample of a patient's blood, purulent discharge, or sputum can help a physician or epidemiologist to isolate or identify a causative agent of infection. Similarly, a saliva sample can permit a scientist or geneticist access to the requisite nucleic acid for genetic sequencing, phylotyping, or other genetic-based studies. In the foregoing examples, in addition to many other situations, it is desirable to work with a fresh biological sample to ensure procurement of accurate results. However, isolation of the probative composition (e.g., nucleic acid, proteins, chemicals, etc.) often requires use of specialized equipment and often benefits from controlled laboratory conditions.

It can be inconvenient and sometimes improbable to require patients/individuals to travel to a biological sample collection center having the appropriate equipment and desirable controlled environment for sample preparation. Similarly, it may be difficult for personnel to directly access the patient/individual, particularly if the sample size is large and/or geographically diverse (e.g., as can be found in large genetic studies of thousands of individuals across an entire country, ethnic population, or geographic region). Further complicating this issue, it is often beneficial to immediately process any procured biological sample, and field personnel may be limited by lack of access to appropriate specialized equipment or to a controlled environment for high-fidelity sample processing.

Some biological sample collection devices and kits have addressed some of the foregoing issues. For example, some commercial kits provide a user with a vial for receiving a biological sample and a preservation reagent that can be added to the collected biological sample, acting to preserve elements within the biological sample (to a certain extent and for a period of time). However, implementations of self-collection systems often rely on inexperienced or untrained individuals to deposit the biological sample into the receiving vessel. This presents a number of problems, including, for example, technical training and precise measurements often required to properly preserve the biological sample for later processing. In the absence of such, it is important to provide a biological sample collection system that can be easily implemented by a novice user and which can preserve the received biological sample for later processing.

Accordingly, there are a number of disadvantages with biological sample collection and preservations systems that can be addressed.

BRIEF SUMMARY

Embodiments of the present disclosure solve one or more of the foregoing or other problems in the art with kits, apparatuses, and methods for collecting and preserving a biological sample.

For example, one or more embodiments can include a biological sample collection system having a sample collection vessel with an opening for receiving a biological sample, a selectively movable valve configured to at least partially associate with the opening of the sample collection vessel, and a sealing cap configured to associate with the selectively movable valve and with the sample collection vessel. The selectively movable valve includes a post having a hollow body and a fluid vent defined by a sidewall portion thereof and a valve head associated with a distal portion of the post and having an aperture selectively alignable with the fluid vent. The sealing cap includes a reagent chamber for storing a measure of sample preservation reagent and is in fluid communication with the hollow body of the post. Associating the sealing cap with the sample collection vessel can cause a physical rearrangement of the post and the valve head such that the fluid vent aligns with the aperture defined by the valve head allowing fluid communication between the reagent chamber and the sample collection vessel.

In some embodiments, the physical rearrangement is or includes a rotational rearrangement of the post relative to the valve head.

In some embodiments, the sample collection vessel includes a connection member and the sealing cap includes a complementary connection member configured to associate with the connection member of the sample collection vessel to couple the sample collection vessel and the sealing cap.

In some embodiments, the connection member includes a ridge projecting away from the sample collection vessel or a depression within the sample collection vessel and the complementary connection member includes a hook or ridge sized and shaped to engage the connection member.

In some embodiments, the connection member and the complementary connection member include threads. The threads of the complementary connection member can be disposed on an inner surface of the sealing cap.

In some embodiments, the fluid vent is obstructed by the valve head when the selectively movable valve is in a closed configuration, and the fluid vent is at least partially aligned with the valve head when the selectively movable valve is in an open configuration.

In some embodiments, the post includes a retaining ring configured to associate with a protrusion or detent within an interior portion of the sealing cap.

In some embodiments, one or more of the post or the valve head includes an annular retention element configured to maintain a tight association between the post and valve head.

In some embodiments, the valve head includes an upper collar disposed proximal of the sidewall portion defining the fluid vent, the upper collar having a greater diameter than the sidewall portion defining the fluid vent and being configured to interface with an interior sidewall of the sample collection vessel.

In some embodiments, a sealing force between the valve head and the post is less than a gripping force between the upper collar of the valve head and an interior sidewall of the sample collection vessel.

An additional, or alternative, biological sample collection system of the present disclosure includes a sample collection vessel including (i) a sample collection chamber with an opening to receive a biological sample into the sample collection chamber, (ii) a sealing cap that includes a reagent chamber having sample preservation reagent stored therein and that is configured to associate with the sample collection vessel, and (iii) a selectively movable valve associated with the sealing cap and configured to move between a closed configuration and an open configuration. The selectively movable valve includes a post in fluid communication with the reagent chamber of the sealing cap and that has a fluid vent defined by a distal sidewall portion thereof. The fluid vent can be transverse to the longitudinal axis of the sealing cap. The selectively movable valve additionally includes a valve head surrounding the distal sidewall portion of the post and defining an aperture sized and shaped to receive the fluid vent. The valve head additionally includes an upper collar proximal to the aperture that is sized and shaped to engage an interior sidewall of the sample collection chamber. The fluid vent forms a fluid-tight association with the valve head in the closed configuration, and the post is operable to move relative to the valve head to configure the selectively movable between the closed configuration and the open configuration.

Embodiments of the present disclosure include methods for collecting and preserving a biological sample. An exemplary method can include the steps of receiving a biological sample at the sample collection vessel of a sample collection system disclosed herein and associating the sealing cap of the sample collection system with the sample collection vessel to cause the selectively movable valve associated with the sealing cap to open, thereby releasing sample preservation reagent held within the sealing cap into the sample collection chamber.

In some embodiments, associating the sealing cap with the sample collection vessel includes threadedly engaging a connection member disposed on an exterior surface of the sample collection vessel with a complementary connection member disposed on an interior surface of the sealing cap.

In some embodiments, associating the sealing cap with the sample collection vessel to cause the selectively movable valve associated with the sealing cap to open includes rotating the post within the associated valve head to at least partially align the fluid vent of the post with the aperture defined by the valve head.

In some embodiments, the method additionally includes the step of accessing a preserved sample within the sample collection vessel by disassociating the sealing cap from the sample collection vessel such that disassociating the sealing cap from the sample collection vessel causes the selectively movable valve associated with the sealing cap to move from an open configuration to a closed configuration.

Embodiments of the present disclosure additionally include kits for collecting and preserving a biological sample. For example, a kit can include a sample collection vessel and a sealing cap. The sample collection vessel includes a sample collection chamber having an opening configured to receive the biological sample into the sample collection chamber and a connection member disposed on an exterior portion the sample collection vessel. The sealing cap includes a reagent chamber storing a measure of sample preservation reagent, a complementary connection member configured to engage the connection member of the sample collection vessel, and a selectively movable valve coupled to the sealing cap. The selectively movable valve is configured to associate with the sample collection chamber and includes a post defining a fluid vent at a distal portion thereof and a valve head associated with the distal portion of the post and defining an aperture. When the selectively movable valve is in a closed configuration, the fluid vent forms a fluid-tight association with the valve head and when the selectively movable valve is in an open configuration, the fluid vent is at least partially aligned with the aperture.

In some embodiments, the kit additionally includes a funnel configured to associate with the sample collection vessel and to guide receipt of a biological sample from a user into the sample collection chamber of the sample collection vessel.

Accordingly, systems, methods, and kits for collecting a biological sample are disclosed herein. This summary is provided to introduce a selection of concepts in a simplified form that are further described below in the detailed description. This summary is not intended to identify key features or essential features of the claimed subject matter, nor is it intended to be used as an indication of the scope of the claimed subject matter.

Additional features and advantages of the disclosure will be set forth in the description which follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims or may be learned by the practice of the disclosure as set forth hereinafter.

BRIEF DESCRIPTION OF THE DRAWINGS

In order to describe the manner in which the above recited and other advantages and features of the disclosure can be obtained, a more particular description of the disclosure briefly described above will be rendered by reference to specific embodiments thereof, which are illustrated in the appended drawings. It is appreciated that these drawings depict only typical embodiments of the disclosure and are not therefore to be considered to be limiting of its scope. The disclosure will be described and explained with additional specificity and detail through the use of the accompanying drawings in which.

DETAILED DESCRIPTION

Figure 1:
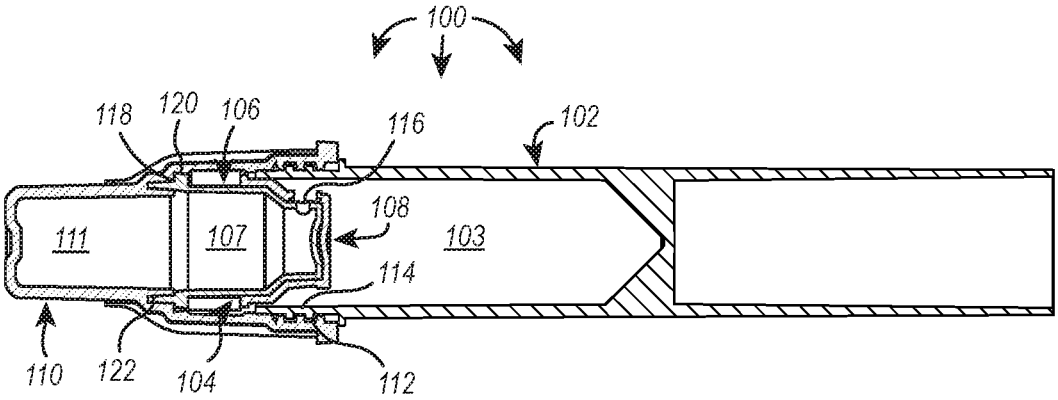
FIG. 1 illustrates a cross-sectional view of an assembled three-dimensional model of a sample collection system with the depicted sealing cap secured to a sample collection vessel and the associated valve in an open configuration.

Embodiments of the present disclosure address one or more problems in the art of systems, kits, and/or methods for collecting and preserving a biological sample. A biological sample can be collected and its contents evaluated for various reasons, including, for example, identifying or characterizing a causative agent of disease (e.g., for treatment of the affected individual, for epidemiological reasons, etc.) or for genetic analysis of a subject's nucleic acid (e.g., genetic phylotyping, gene expression studies, genome sequencing, etc.). In most instances, including within the foregoing examples, it is desirous that the fidelity of the biological sample be maintained so that it retains its probative value. However, collecting and preparing biological samples for analysis has traditionally been a complex endeavor for the skilled technician or specialized professional. This is problematic for obvious reasons, including the time and cost associated with individually collecting and transporting biological samples, particularly when the subjects reside in disparate rural locations and require service from personnel with the proper skill set to properly collect and preserve the biological sample.

Embodiments of the present disclosure provide sample collection and preservation systems and kits, and methods for using the same, which address one or more of the foregoing problems. For example, utilizing systems, kits, and methods for collecting and preserving biological samples, as disclosed herein, removes the need of specialized personnel when collecting and initially preserving a biological sample. Furthermore, the disclosed embodiments simplify sample collection and preservation, which decreases the likelihood that even an unskilled user will err when collecting and preserving a biological sample.

As an illustrative example of the foregoing, biological sample collection kits disclosed herein include at least a two-piece sample collection and preservation system. A first portion includes a sample collection vessel or vessel, which can be detachably associated with a funnel. When used, the funnel acts to guide the receipt of a biological sample from a user into the sample collection chamber of the collection vessel or vessel. The funnel can also make it easier for a user to engage the collection vessel and deposit a biological sample into the sample collection chamber. After depositing the requisite amount of biological sample (which may be indicated by a mark on the sample collection vessel), a user can remove the funnel (if used) and associate the second portion of the two-piece sample preservation system—e.g., a sealing cap associated with a selectively movable valve—with the collection vessel. The reagent chamber of the sealing cap has been pre-filled with a predetermined amount of sample preservation reagent, and as the sealing cap is drawn down to seal the received biological sample within the sample collection chamber of the collection vessel, the valve enters an open configuration and the preservation reagent is released from the reagent chamber, through the open valve, and into the sample collection chamber where it mixes with and preserves the received biological sample.

As described in more detail below, the valve can be opened to release reagents from the reagent chamber into the sample collection chamber. In some embodiments, a proximal portion of the selectively movable valve is mechanically interlocked (e.g., via a friction fit) with the sealing cap such that the post moves in unison with the sealing cap. A valve head is secured to the distal portion of the post forming a fluid tight connection therebetween. The valve head is sized and shaped to fit within the opening of the sample collection vessel and includes a collar that is configured in size and shape to engage the inner wall of the sample collection chamber (or structure associated therewith). Upon association of the sealing cap with the sample collection vessel, the valve cap enters the sample collection chamber and engages the inner wall thereof. As the sealing cap is further secured to the sample collection vessel (e.g., by threaded engagement), the post moves in conjunction with the sealing cap, and the valve cap remains stationary. In this way, the post moves (e.g., rotates) relative to the valve head, causing the selectively movable valve to open (e.g., by undergoing a physical rearrangement). The independent movement of post relative to the valve cap can be enabled by, for example, the force (e.g., frictional force or force required to overcome a mechanical interlock) between the post and valve head (which forms a fluid tight connection) being less than the force between the valve head and the sample collection chamber. When moved to an open configuration, the previously obstructed fluid vent formed by the post is at least partially aligned with the aperture formed in the body of the head valve, thereby creating a conduit for communicating the sample preservation solution from the reagent chamber of the sealing cap into to the sample collection chamber.

It should be appreciated that in some embodiments, opening of the selectively movable valve reversible. That is, the selectively movable valve can be moved from an open configuration to a closed configuration. For example, embodiments of the disclosed apparatus can be configured so that disassociating the sealing cap from the sample collection vessel can cause the selectively movable valve to close. In an exemplary case, unscrewing the sealing cap from the sample collection vessel causes the post to move relative to the valve cap. As a result, the valve cap aperture and post fluid vent become misaligned such that fluid vent forms a fluid tight seal with the interior surface of the valve cap—placing the selectively movable valve in a closed configuration.

As can be appreciated from the foregoing, in addition to alternative and/or additional embodiments provided herein, the systems, kits, and methods of the present disclosure can be used by skilled or unskilled individuals with reduced likelihood of error associated with collecting and at least initially preserving a biological sample. Accordingly, implementations of the present disclosure can reduce the cost associated with procuring biological samples for diagnostic, scientific, or other purposes and can increase the geographic reach of potential sample collection areas without the need of establishing the necessary infrastructure (e.g., controlled environments conducive to sample collection and preservation, skilled personnel to physically collect, transport, and/or preserve the biological samples, etc.).

As used herein, the term "biological sample" can include any cell, tissue, or secretory fluid (whether host or pathogen related) that can be used for diagnostic, prognostic, genetic, or other scientific analysis. This can include, for example, a human cell sample such as skin. It can also include a non-human cell sample that includes any of a bacterium, virus, protozoa, fungus, parasite, and/or other prokaryotic or eukaryotic symbiont, pathogen, or environmental organism. The term "biological sample" is also understood to include fluid samples such as blood, urine, saliva, and cerebrospinal fluid and extends to other biological samples including, for example, mucus from the nasopharyngeal region and the lower respiratory tract (i.e., sputum).

As used herein, the "probative component" of the biological sample refers generally to any protein, nucleic acid, surface moiety, or other compound that can be isolated from the biological sample. Preferably, the probative component is or includes nucleic acid, more preferably DNA. In a preferred embodiment, the biological sample is or includes saliva, which presumptively contains a preferable probative component in the form of the user's genetic material (e.g., DNA and RNA).

Sample Collection Systems and Kits

In one embodiment, a biological sample is collected, preserved, and stored in a collection vessel as part of a multi-piece sample collection system or kit. A first piece of the system or kit includes a collection vessel, a second piece includes a sample collection funnel, which may be packaged separately from or removably connected to the collection vessel, and a third piece includes a sealing cap having a selectively movable valve comprised of a post and a valve head and a reagent chamber disposed within or integrated with the sealing cap. The sealing cap is configured to associate with the collection vessel, to dispense sample preservation reagents into the collection vessel through the selectively movable valve, and to seal the contents of the sample collection chamber therein.

For example, FIG. 1 illustrates a cross-sectional view of an assembled three-dimensional model of a sample collection system 100. The system 100 includes a sample collection vessel 102 and optionally, a funnel (not shown), which can be associated with a top portion of the collection vessel 102 and in fluid communication with a sample collection chamber 103 of the collection vessel 102. The biological sample collection system 100 can also include a selectively movable valve 104 comprised of a post 106 and a valve head 108 associated with a sealing cap 110 that has a reagent chamber 111 disposed within or integrated with the sealing cap 110. The sealing cap 110—together with the selectively movable valve 104—can be sized and shaped to associate with a top portion of the collection vessel 102 such that the cap 110 fits over and seals an opening of the sample collection chamber 103 and at least a portion of the valve 104 (e.g., the valve head 108 and associated portion of the post 106) extends into the opening of the sample collection chamber 103.

In some embodiments, the reagent within the reagent chamber 111 includes a preservation or buffering solution that protects the integrity of the probative component of the biological sample prior to purification or testing. Preservation reagents are typically chemical solutions and may contain one or more salts (e.g., NaCl, KCl, Na2HPO4, KH2PO4, or similar, and which may, in some implementations, be combined as a phosphate buffered saline solution, as known in the art), lysing agents (e.g., detergents such as Triton X-100 or similar), chelating agents (e.g., ethylenediaminetetraacetic acid (EDTA), ethylene glycol-bis(β-aminoethyl ether)-N,N,N',N'-tetraacetic acid (EGTA), or similar), distilled water, or other reagents known in the art. In one or more embodiments, the reagent or buffering solution stabilizes at least one probative component within the sample (e.g., nucleic acids, such as DNA and RNA, protein, etc., and combinations thereof) during transfer, transportation, and/or storage at a laboratory, clinic, or other destination. After the preservation solution is added, the sample can be stored at or below room temperature for weeks or months without significant loss of the probative component. That is, the sample can still be utilized for diagnostic, genetic, epidemiologic, or other purposes for which it was collected after storage for weeks or months in the preservation solution.

With continued reference to FIG. 1, the sealing cap 110 and a saliva funnel (not shown) can each independently attach to the sample collection vessel 102 using a connection mechanism. The connection mechanism can include, for example, threads, snap or press fit connections, tongue and groove members, bayonet connection, or other interlocking or mechanically coupling mechanisms. For example, a funnel can be first attached to the sample collection vessel 102 via complementary connection mechanisms (e.g., complementary threads; not shown). After facilitating receipt of a biological sample from a user, the funnel can be removed by reversing the complementary connection mechanism (e.g., unscrewing the funnel; not shown), and a sealing cap 110 can be secured to the collection vessel 102 using a same or similar complementary connection mechanism. For example, as shown in FIG. 1, the sealing cap 110 can include connection members 112 (e.g., threads) located on an inner circumferential wall of the sealing cap 110 that are complementary to and work in conjunction with the connection members 114 (e.g., complementary threads) disposed on an exterior surface of the sample collection vessel 102.

In some embodiments, the connection mechanism between the funnel and collection vessel is different than the connection mechanism between the solution cap and the collection vessel. For example, the funnel may be press fit or snap fit onto the collection vessel, whereas the solution cap is rotationally secured through engagement of complementary threads located on an exterior portion of the collection vessel and an interior portion of the solution cap or vice versa. Regardless of the attachment mechanism used, a sample preservation fluid can be introduced into the sample collection chamber 103 and mixed with the deposited biological sample as a result of the sealing cap 110 being attached to the sample collection vessel 102. As provided earlier, this can be due to the selectively movable valve 104 opening and allowing reagent to be released through fluid vent 116 defined by the open valve and into the sample collection chamber 103.

The sealing cap 110 is configured to receive a measure of reagents into the reagent chamber 111, and as shown by the cross-sectional views of the assembled sample collection system 100 in FIG. 1, a selectively movable valve 104 is associated with the sealing cap 110. The post 106 can be snap-fittingly received into the sealing cap 110, creating a fluid tight connection therebetween. As illustrated, the post includes a retaining ring 118 into which a protrusion 120 of the interior sidewall of the sealing cap 110 inserts to stabilize the post 106. In some embodiments, the interaction between the protrusion 120 and the retaining ring 118 creates the fluid tight connection between the sealing cap 110 and the post 106. Additionally, or alternatively, an upper collar 122 of the post extends into the body of the sealing cap 110 or into the reagent chamber 111 and is secured via an interference fit, thereby creating a fluid tight connection between the reagent chamber 111 and the post 106. The retaining ring 118 can, in some embodiments, secure the post 106 with the cap 110 and prevent creep that is common to thermoplastic components secured by threaded engagement members.

As further illustrated by FIG. 1, the post 106 includes a reagent retention chamber 107 in fluid communication with the reagent chamber 111 of the sealing cap 110. The post 106 defines a fluid vent 116, and when the valve 104 is in an open configuration, reagent may be transferred from the reagent chamber 111 to the sample collection chamber 103 through the vent 116. The valve 104 is shown in FIG. 1 as being aligned in an open configuration. However, as shown in FIG. 2, the selectively movable valve 104 can be arranged in a closed configuration, and when associated with the sealing cap 110 in this state, any reagent disposed within the reagent chamber 111 would be retained and sealed within the reagent chamber 111 and reagent retention chamber 107.

Figures 2, 3:
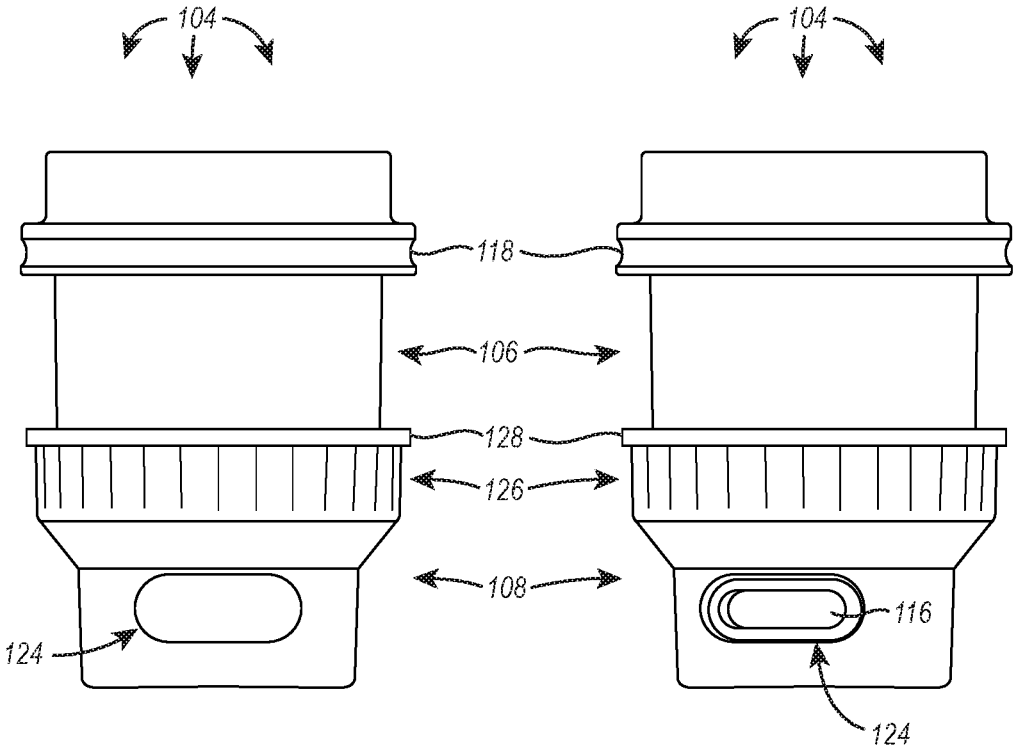
FIG. 2 illustrates a front elevation view of a selectively movable valve depicted in a closed configuration.
FIG. 3 illustrates a front elevation view of the selectively movable valve of FIG. 2 depicted in an open configuration.

That is, the fluid vent 116 is obstructed by the valve head 108 of the selectively movable valve 104 when the valve 104 is in a closed configuration, as illustrated in FIG. 2. In this state, an aperture 124 defined by a sidewall of the valve head 108 is misaligned with the fluid vent 116 of the post 106, and the interaction between the interior sidewall of the valve head 108 and the exterior sidewall of the post 106 creates a fluid tight connection—at least at and/or around the fluid vent 116. The fluid tight connection between the valve head 108 and the post 106 prevents the premature or unintentional expulsion of reagent from the solution cap 110.

In some embodiments, the fluid vent contains a protruding or raised surface around the mouth of the fluid vent. The raised surface interacts with the interior surface of the valve head, acting to concentrate the sealing force between the mouth of the fluid vent and the valve head to create a fluid-tight seal. This configuration of elements can additionally reduce the overall rotational force required to rotate the post relative to the valve head. Further, the raised surface around the mouth of the fluid vent can be sized and shaped to interlock with the aperture of the valve head (e.g., as shown in FIG. 3), which may beneficially act to prevent over rotation of the valve.

As the complementary threads 114, 112 between the sealing cap 110 and the sample collection vessel 102 are inter-engaged and the sealing cap 110 is advanced towards the sample collection vessel 102, the valve head 108 and associated distal portion of the post 106 are introduced or further drawn into the opening of the sample collection chamber 103. The collar 126 of the valve head 108 has a larger diameter than the distal portion of the valve head comprising the aperture 124, and this larger diameter collar 126 is sized and shaped to fit within the opening of the sample collection chamber 103 where it engages the sidewall thereof. A resistive force derived from the engagement of the valve head 108 with the chamber sidewall is greater than the force between the post 106 and the valve head 108. As torque (or other force) is applied to the solution cap 110 to further associate the solution cap 110 with the sample collection vessel 102, the force between the post 106 and the valve head 108 is overcome, causing the post 106—which is directly connected to the sealing cap—to rotate along with the sealing cap while the valve head 108 remains respectively stationary. Accordingly, the selectively movable valve 104 undergoes a conformational change from a closed configuration (as shown in FIG. 2) to an open configuration where the post 106 rotates within the valve head 108 to at least partially align the fluid vent 116 with the aperture 124 (as shown in FIG. 1 and FIG. 3).

In some embodiments, the resistive force derived from the engagement of the valve head 108 with the chamber sidewall is the result of an interference fit formed between the valve head 108 and the chamber sidewall. The interference fit can, in some embodiments, be a liquid-tight fit.

As further illustrated in FIG. 1, the valve head 108 can include a flange 128 that abuts and is impeded by the rim of the sample collection chamber 103 that defines the opening thereof. This prevents the valve head 108 from advancing completely within the sample collection chamber 103 and may, in some embodiments, provide additional force to retain the valve head 108 in a stationary position while the post 106 rotates relative thereto. In some embodiments, the collar 126 is angled such that the frictional force increases as the distal portion of the valve 104 is drawn further into the opening of the chamber 103. In this way, the frictional force between the valve head 108 and the chamber sidewall increases until it surpasses a threshold equivalent to the starting friction between post 106 and the valve head 108, at which time the post 106 begins to rotate relative to the valve head 108. The post 106 can continue to rotate relative to the valve head 108 until the aperture 124 and fluid vent 116 at least partially align—structurally reconfiguring the valve 104 to an open configuration. Reagent within the reagent chamber 103 can then be communicated from the reagent retention chamber 107 of the post 106, through the fluid vent 116 and aperture 124, and into the sample collection chamber 103.

In some embodiments, the rotational distance required to open the selectively movable valve 104 is proportional to the distance required to at least partially unobstruct the fluid vent 116. This distance may be the same or less than the distance traversed by the solution cap 110 from initial engagement of the connection members 114, 112 to a sealed position of the cap 110 and vessel 102. The fluid vent 116 and aperture 124 can be aligned in substantially the same plane in both the open and closed configurations, and the fluid vent 116 and aperture 124 can remain substantially (or at least partially) aligned in an open configuration when the sealing cap 110 is sealed to the vessel 102.

However, it should be appreciated that although a single fluid vent 116 and a single aperture 124 are illustrated in FIGS. 1-3, in some embodiments there can be additional fluid vents and/or additional apertures. For example, a second fluid vent (not shown) can be defined on the opposite side of the post. Additionally, or alternatively, one or more additional fluid vents and/or apertures can be defined 15°, 30°, 45°, 60°, 75°, 90°, 105°, 120°, 135°, 150°, 165°, or 180° away from the first fluid vent/aperture or at any angle between any two of the foregoing endpoints away from the first fluid vent/aperture in a clockwise and/or counterclockwise direction. Additionally, fluid vents and/or apertures can be placed at varying elevations along the post and/or valve head, respectively.

Additionally, or alternatively, the fluid vents and/or apertures can be a different shape and/or align to a different degree than that illustrated in the figures. In some embodiments, the fluid vent and aperture are at least partially aligned for a period of time sufficient to allow a preserving volume of reagent to flow from the reagent chamber and into the sample collection chamber. For example, the fluid vent may be disposed adjacent to an elongate aperture defined by the valve head (e.g., extending one quarter to one half of the way around the circumference of the valve head) such that upon rotation of the post within the valve head, the fluid vent is partially unobstructed by the valve head sidewall and aligned with a portion of the aperture. Reagent can be communicated through the partially unobstructed fluid vent, and as the post continues to rotate, the fluid vent becomes successively less obstructed until it is essentially fully unobstructed. Continued rotation of the post relative to the valve head can cause the fluid vent to traverse the aperture, maintaining an open configuration. Such an embodiment reduces the necessity of coordinated precision in the spacing of the fluid vent and aperture relative to the rotational distance for sealing the vessel with the sealing cap.

In some embodiments, securing the sealing cap to the vessel causes rotation of the post relative to the valve head, which moves the valve from a closed configuration to an open configuration. Continued tightening of the sealing cap causes continued rotation of the post such that the fluid vent traverses the length of the aperture and the fluid vent is again occluded by a portion of the valve head interior sidewall—thereby moving the valve from an open configuration to a closed configuration.

While in a preferred embodiment, direct mechanical interactions between the collar 126 and a sidewall of the sample collection chamber 103 enables the structural rearrangement of the valve 104 from a closed configuration to an open configuration, other mechanisms of opening and/or closing the selectively movable valve are envisioned herein. In some embodiments, the collar includes a projection or other structural feature that engages an element attached or formed into the sample collection chamber sidewall to prevent rotation of the valve head. For example, the collar can include a radially projecting fin that engages a sidewall protrusion or ridge that physically obstructs movement of the valve head within the chamber. In some embodiments, the radially projecting fin (or a plurality thereof) is positioned such that the valve head is engaged by the fin and causes the valve head to rotate a defined degree to cause at least partial alignment of the valve head with the aperture upon sealing of the vessel by the sealing cap. In some embodiments, the fin or other structural feature engages a channel or keyway within the chamber sidewall that allows rotation of the valve in concert with the cap for a measured rotational degree after which the channel/keyway ends or continues downward, preventing the valve head from rotating while allowing the valve head to continue to traverse downward within the sample collection chamber.

Regardless of form, the selectively movable valve 104 is configured to structurally rearrange from a closed configuration to an open configuration in response to engaging the sealing cap 110 with the sample collection vessel 102. Accordingly, tightening the association of the solution cap 110 with the sample collection vessel 102 forces the selectively movable valve 104 into an open configuration where the valve head 108 rotates relative to the post 106. In some embodiments, the process can be reversed. That is, loosening the association of the solution cap 110 with the sample collection vessel 102 allows the post 106 to rotate the opposite direction, obstructing the fluid vent 116 and/or causing misalignment of the fluid vent 116 and aperture 124 to thereby return the selectively movable valve 104 to a closed configuration. Accordingly, embodiments of the present disclosure enable sample collection systems having a sample collection vessel and selectively movable valve that can be selectively and reversibly sealed, unsealed, and resealed—whether in connection with sealing and unsealing the sample collection vessel or otherwise.

Figure 4:
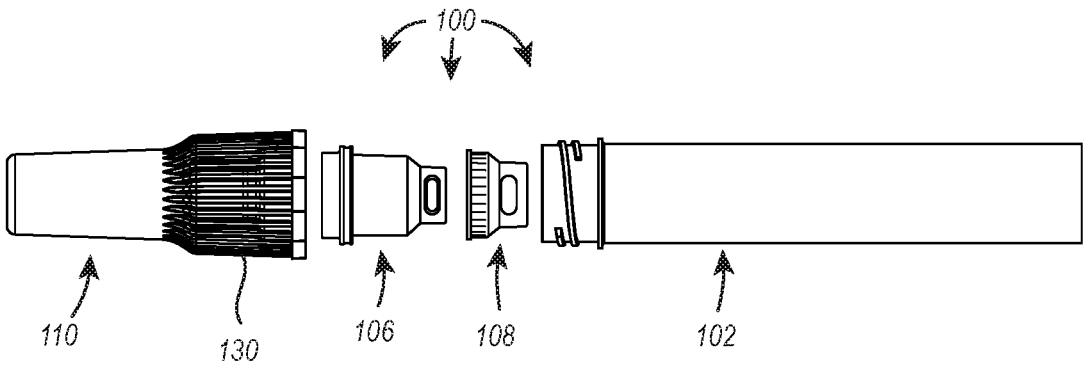
FIG. 4 illustrates an exploded elevation view of a sample collection system similar to the system depicted in FIG. 1 that includes a cap configured to receive a selectively movable valve.

With reference to FIG. 4, illustrated is an exploded elevation view of a sample collection system 100 akin to the cross-sectional view of the three-dimensional model depicted in FIG. 1. Each of the sealing cap 110, post 106, valve head 108, and sample collection vessel 102 are illustrated in an unassembled state, depicting the aligned arrangement of each component of the system 100. As shown, the sealing cap 110 may additionally include a plurality of external ridges 130. The external ridges 130 can facilitate a better grip the sealing cap 110 while positioning the cap 110 over the sample collection vessel 102. Additionally, or alternatively, the external ridges 130 can be used to rotate and close the sealing cap 110 onto sample collection vessel 102. In some embodiments, the external ridges 130 may beneficially enable the user to more forcefully torque the sealing cap 110 and can provide the user with a better grip during that process. The external ridges 130 can also facilitate opening and closing of the selectively movable valve 104 and/or removal of the sealing cap 110 at the laboratory when accessing the biological sample, such as manually or by an automated cap removal mechanism.

Figure 5A:
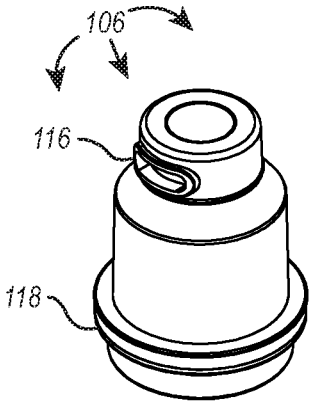
FIG. 5A illustrates a perspective view of the post depicted in FIG. 4.
Figure 5B:
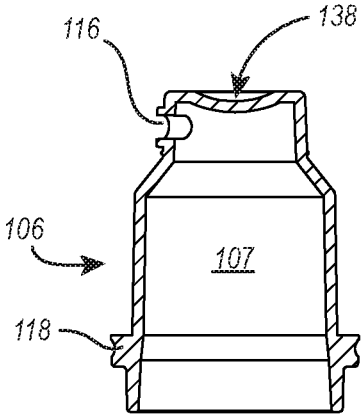
FIG. 5B illustrates and front cross-sectional view of the post depicted in FIG. 5A.
Figure 5C:
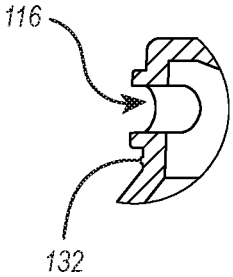
FIG. 5C illustrates a magnified view of the fluid vent defined by the distal portion of the post of FIG. 5B.

Referring now to FIGS. 5A-5C, the post 106 is illustrated in perspective (FIG. 5A) and front cross-sectional views (FIGS. 5B and 5C) with a magnified view of the fluid vent 116 provided in FIG. 5C. As shown, the post 106 includes one or more tapered regions, which can, among other things, help fit the post 106 into the sealing cap 110 and into the valve head 108. For example, the post 106 includes an upper collar 122 that is sized and shaped to fit within the sealing cap 110 and to create a fluid tight seal therewith (as described above). As shown, the upper collar 122 can be tapered with a larger diameter adjacent the retaining ring 118 and a smaller diameter moving away from the retaining ring 118 toward the proximal end thereof. The smaller diameter end of the upper collar 122 can be a smaller diameter than the diameter of the reagent chamber 111 (or other portion of the sealing cap 110 to which the post is secured), which can beneficially allow the post 106 to be more easily associated with the solution cap 110. As the diameter of the upper collar 122 increases moving away from the proximal end, it reaches a diameter sufficient to form an interference fit or mechanical interlock with the associated reagent chamber 111 (or other portion of the sealing cap 110 to which the post is secured). In some embodiments, the interference fit between the upper collar 122 and the associated reagent chamber 111 (or other portion of the sealing cap 110 to which the post is secured) is a fluid-tight fit.

As additionally shown in FIGS. 5A-5C, the post 106 can include a retaining ring 118 into which a protrusion 120 of the interior sidewall of the sealing cap 110 inserts to secure the post 106 to the sealing cap. The retaining ring 118 can alternatively include a seal, such as an O-ring or elastomeric material that can compress against the sealing cap 110 to form a fluid-tight seal between the sealing cap 110 and the post 106.

The post 106 additionally includes a proximal end that is sized and shaped to fit within the valve head 108. As illustrated, the distal end includes a tapered exterior sidewall, an annular retention element 132, and the fluid vent 116. As shown, the fluid vent 116 can extend a distance away from the tapered exterior sidewall, such that when the valve 104 is in a closed configuration, the fluid vent 116 contacts the interior surface of the valve head 108 and forms a fluid-tight association therewith, and when the valve 104 is in an open configuration, the fluid vent 116 protrudes into the aperture 124 formed by the valve head 108. In some embodiments, the fluid vent 116 is flush with the interior sidewall of the valve head 108 when the valve 104 is in the closed configuration and at least partially aligns with the aperture 124 in the open configuration without extending therein. In some embodiments, the curvature of the fluid vent 116 is substantially the same or complementary to the curvature of the interior sidewall of the valve head 108, thereby enabling a fluid tight association therebetween.

The retention element 132 can additionally, or alternatively, engage a portion of the valve head 108 such that a tight association is maintained between the post 106 and valve head 108 upon the valve 104 entering the open configuration. In some embodiments, the annular retention element 132 is positioned on a proximal end of the fluid vent 116 and forms a fluid tight connection with the valve head 108. Additionally, or alternatively, the annular retention element 132 is positioned on a distal end of the fluid vent 116.

Figure 6A:
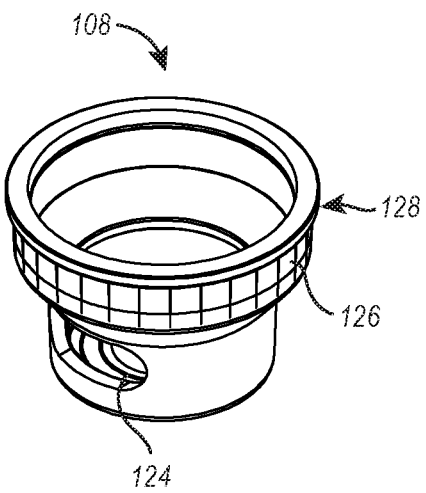
FIG. 6A illustrates perspective view of the valve head depicted in FIG. 4.
Figure 6B:
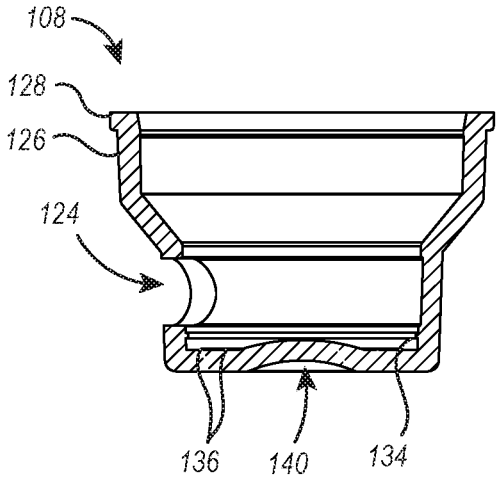
FIG. 6B illustrates a cross-sectional view of the valve head depicted in FIG. 6A.

Referring now to FIGS. 6A-6B, illustrated are perspective (FIG. 6A) and front cross-sectional views (FIG. 6B) of the valve head 108. As shown, the interior sidewall defining the aperture of the valve head 108 can be tapered complementary to the post 106. For example, the interior sidewall of the valve head 108 can be tapered from a proximal end to a distal end at the same angle or degree as the post 106. In such an embodiment, the interior sidewall of the valve head 108 may associate directly with the exterior sidewall of the post 106 along substantially the entire length of the valve head and form an interference fit therebetween. As another example, the interior sidewall of the valve head 108 can be tapered from a proximal end to a distal end at a greater angle or degree than the post 106 such that a portion of the post 106 remains distanced from the interior sidewall when associated therewith. In either of the foregoing examples, and as shown in FIGS. 1-3, an interference fit, which can additionally be a fluid-tight fit, can be created between the post 106 and the valve head 108 to form the selectively movable valve 104.

The valve head 108 can additionally include one or more annular retention elements 134, 136 disposed on an interior sidewall of the valve head 108. For example, as perhaps better shown in FIG. 6B, the valve head 108 includes a first annular retention element 134 disposed on the sidewall of the valve head 108 at a distal side of the aperture 124. The valve head 108 additionally includes a plurality of concentric annular retention elements 136 disposed on the bottom, distal surface of the interior of the valve head 108. The annular retention elements 134, 136 can associate with the post 106 and, in some embodiments, form a fluid tight connection with the post 106.

For example, the annular retention element 134 can be a sidewall protrusion that forms a fluid-tight interference fit with an exterior sidewall of the post. The annular retention element can be an uninterrupted annulus around a circumference of the valve head to ensure a fluid tight seal is formed between the valve head and the post. As shown in FIG. 6, the annular retention element 134 may be positioned distally to the aperture 124 to prevent fluid from the reaction chamber from flowing or leaking between the valve head and the post and to beneficially promote fluid flow through the aperture and into the sample collection chamber upon alignment of the aperture with the associated fluid vent.

In some embodiments, the post may include a complementary channel for receiving the annular retention element. In such embodiments, the channel is preferably sized and shaped to receive the annular retention element and allow for rotation of the annular retention element therein while simultaneously providing a fluid tight connection therebetween. Alternatively, the post includes its own annular retention element that forms a fluid tight connection (e.g., via an interference fit) with the annular retention element of the valve head. For example, when the valve head is initially associated with the post (e.g., during assembly), annular retention element of the valve head may pass over the annular retention element of the post creating a fluid tight connection between the distal surface of the valve-head-associated annular retention element and the proximal surface of the post-associated annular retention element.

In some embodiments, and as shown in FIGS. 5A-5C, 6A and 6B, the post 106 and/or valve head 108 may include an arcuate indent 138, 140. When both are present, the arcuate indent 140 of the valve head 108 can be the same or substantially the same contour as the arcuate indent 138 of the post 106. In some embodiments, the arcuate indent 138, particularly when present in the post 106, can assist in more efficiently directing the flow of sample preservation reagent through the fluid vent 116 and can additionally, or alternatively, reduce the volume of sample preservation reagent remaining (e.g., pooling) in the distal end of the post 106. In an alternative embodiment, the lower lip of the fluid vent is formed by the bottom surface of the distal end of the post.

In some embodiments, the post 106, valve head 108, and/or any of the annular retention elements 132, 134, 136 can be made of or include an elastic (e.g., elastomer) material configured to flex under strain, allowing interference fits, particularly fluid tight seals to form between interacting surfaces. Additionally, or alternatively, any of the post 106, valve head 108, and/or any of the annular retention elements 132, 134, 136 can be made of or include a rigid material (e.g., a thermoplastic, plastic, metal, or alloy). In a preferred embodiment, one of the post 106 and valve head 108 is made of or includes a material that is more elastic and/or less rigid than the other. For example, the post can be made of polypropylene or a polyester (e.g., polyethylene terephthalate (PET) or polyethylene terephthalate, glycol-modified (PETG)) whereas the valve head can be made of polyethylene (e.g., ultra-high-molecular-weight polyethylene (UHMW) or high-density polyethylene (HDPE)). The properties of the material should allow for a fluid tight connection between the post 106 and the valve head 108 and further enable the selectively movable valve 104 to transition between open and closed configurations.

In embodiments where the valve head includes an arcuate indent (e.g., indent 140 of FIG. 6), the indent may press against the bottom surface of the post and apply a sealing pressure between the interacting annular retention elements (e.g., elements 132, 134). The arcuate indent may be configured to flex and therefore beneficially provide a mechanism for maintaining a fluid tight connection between the post and valve head despite variations in manufacturing tolerances affecting the contour and/or position of elements associated with the post and valve head.

Methods Implementing a Solution Cap Having a Selectively Movable Sleeve Arm

With continued reference to FIGS. 1-6, methods disclosed herein can include a method of assembling a multi-part sample collection kit for use in preserving a biological sample. Assembling the sample collection kit can include preparing the solution cap 110. This can include, for example, filling the solution cap 110 with a measure of sample preservation reagent followed by mechanically interlocking the valve 104 with the solution cap 110 either serially—press-fitting the post 106 into association with the solution cap 110 followed by fluid-tight association of the valve head 108 with the post 106—or as a preformed valve 104 comprising the post 106 and valve head 108 connected in a closed configuration. Accordingly, assembly of the valve 104 can occur before, during, or after the post 106 is attached to the solution cap 110. Assembling the kit can further include acquiring a sterile sample collection vessel 102, and optionally a sterile funnel, and combining the components in a package for later use.

When obtained by a user, the kit described above can be assembled and used to preserve a biological sample. In an exemplary implementation, a biological sample is received into the sample collection vessel 102. The received biological sample can enter directly into the sample collection chamber 103 or can be introduced via gravitational flow along the interior sidewall of an optionally attached funnel. If the funnel is used, it is removed from the sample collection vessel 102 after facilitating receipt of the biological sample. The sealing cap 110 and associated closed valve are brought into association with the sample collection vessel 102 by inserting the distal portion of the valve 104 into the opening defined by the sample collection chamber 103 and securing the sealing cap 110 over the top of the sample collection vessel 102 (e.g., by rotating the sealing cap 110 along complementary threads 112, 114 between the cap 110 and the vessel 102). The selectively movable valve 104 undergoes a conformational change when the sealing cap 110 is secured over the collection vessel 102, transitioning the valve 104 from a closed configuration to an open configuration. The reagent stored within the sealing cap 110 is communicated into the sample collection chamber 103, and in some embodiments, the collection vessel 102 can be shaken or otherwise agitated to allow all or at least most of the preservation reagent to cover and mix with the collected sample. The sample is chemically and biologically preserved through association with the sample preservation reagent and is beneficially protected from the outside atmosphere due to the fluid- and/or air-tight seal formed between the sealing cap 110 and vessel 102. This reduces the chance of sample contamination and helps maintain the integrity of the probative component during transportation to and/or storage at the processing facility.

In an exemplary case, during assembly of the valve 104, the valve head 108 is connected to the post 106 such that valve head 108 can rotate with respect to the post 106, but it cannot move laterally with respect thereto. Accordingly, the aperture 124 and fluid vent 116 are aligned in the same horizontal plane when the valve 104 is formed. In the closed configuration, the fluid vent 116 is offset from the aperture 124 and creates a fluid-tight seal with the interior sidewall of the valve head 108 (e.g., through physical interference between the complementary opposing surfaces).

As the sealing cap 110 is brought into association with the vessel 102, the distal end of the valve 104 (including the distal ends of the post 106 and valve head 108 that comprise the occluded fluid vent 116 and aperture 124, respectively) enters the sample collection chamber 103. As the sealing cap 110 is brought into tighter association with the vessel 102, the valve is pulled farther into the sample collection chamber 103 until the distal end of the collar 126 engages the interior sidewall of the chamber 103. At this point, the collar 126 engages the chamber sidewall and resists the rotational force transitively applied to it by the sealing cap 110. The frictional force between the collar 126 and the chamber sidewall exceeds the threshold force (e.g., frictional force) preventing the post 106 (and fluid vent 116) from rotating relative to the valve head 108. As a result, the valve head 108 discontinues rotating as a result of the torque applied to the sealing cap 110, but the post 106 continues to rotate with the sealing cap 110, causing the fluid vent 116 to move toward the aperture 124 and into the open configuration.

It should be noted that as the post 106 rotates, it is also being drawn further into the sample collection chamber 103, as rotation of the sealing cap 110 causes the sealing cap 110 to advance towards the vessel 102 and become more tightly associated therewith. Thus, as the post 106 rotates and is drawn further into the chamber 103, the post 106, while not rotating, is nonetheless drawn farther down into the chamber 103 as well. Accordingly, the post 106 can rotate and be drawn into the chamber 103 only so far as the flange 128 is not engaging the rim of the chamber 103. In some embodiments, the fluid vent 116 and aperture 124 are at least partially aligned after less than half a turn (180°; e.g., a quarter turn (90°)), and at the same time as flange 128 engages the rim of the sample collection chamber 103.

Alternatively, the fluid vent 116 aligns with the aperture 124 before the flange 128 prevents vertical traversal of the valve within the sample collection chamber 103. In some embodiments, alignment of the fluid vent 116 with the aperture 124 causes the fluid vent 116 to protrude and mechanically interlock into the aperture 124. In this instance, the frictional force between the collar 126 and the interior sidewall of the chamber 103 may be less than the force required to disengage the fluid vent 116 from the aperture 124. Accordingly, the valve head 108 can resume rotating along with the post 106 and sealing cap 110, though a greater rotational force would need to be applied to the sealing cap 110 than before the collar 126 was frictionally engaged by the chamber sidewall.

It should be appreciated that the solution cap can secure to and seal the collection vessel by any means described herein or as known in the art. Further, while one particular structure and associated method for opening the selectively movable valve is depicted in FIGS. 1-6, it should be appreciated that other methods and structural configurations are included within the scope of the present disclosure. For example, although the depicted embodiments illustrate the post as having the fluid vent and the valve head having the aperture, in some embodiments, the fluid valve and aperture may be switched between components or replaced by other complementary components that perform the same or similar function. For example, the post may include an aperture into which the fluid vent of the valve head aligns when moving from a closed configuration to an open configuration.

As another example, the valve can be moved into an open configuration by rotating the fluid vent into a position where the valve head lacks a sidewall. In other words, the aperture may be the absence of a sidewall. For example, as described above, the fluid vent can be tightly associated with the interior sidewall of the valve head, and upon rotation of the fluid vent relative to the valve head sidewall, the fluid vent passes over the sidewall edge and becomes unobstructed by any sidewall, allowing the sample preservation reagent to be freely communicated through the fluid vent. In some embodiments, the valve head lacks a sidewall configured to tightly associate with and prevent fluid flow through the fluid vent along less than 270°, less than 225°, less than 180°, less than 135°, less than 90°, or less than less than 45° of its circumference.

As yet a further example, the aperture can be a keyway within the valve head that has both a vertical and horizontal component. Upon aligning the fluid vent with the keyway, the valve head may remain stationary with the post moving vertically within the valve head while also rotating. The keyway, similarly, curves downward along the body of the valve head, following the trajectory of the post to maintain the valve in an open configuration. In some embodiments, multiple keyways are disposed in a radially descending pattern. For example, a keyway may begin every 90° along the circumference of the valve head. In this way, assembling the valve may be simplified, as relatively any placement of the fluid vent between adjacent keyways can result in a functional valve. This can additionally act to eliminate the potential time-consuming, precise placement of the fluid vent relative to the aperture during assembly to ensure the degree of available rotation of the post relative to the valve head is sufficient to cause the fluid vent to align with the aperture.

In some embodiments, the solution cap is under pressure and moving the selectively movable valve into an open configuration causes the sample preservation reagent stored within the solution cap to be forcefully expelled into the sample collection chamber. This can beneficially encourage stored reagent to mix with the collected sample and may additionally act to preserve the reagent and/or the probative component thereof.

Methods can additionally include removing the preserved sample from the sample collection system. This can involve, for example, the steps of unscrewing or otherwise removing the solution cap from the sample collection vessel. In some embodiments, the process of removing the cap causes the valve to return to a closed configuration, thereby resealing the valve. The sample collection system is designed in some embodiments so that the solution cap and valve can—at this point—be removed from the sample collection vessel without the catastrophic failure of any components. That is, the sample collection system can be designed so that the collar of the valve head can be disengaged from the sidewall of the sample collection chamber while maintaining the integrity of the sealing cap-valve assembly. This can be enabled, for example, by engineering the components such that the mechanical force required to disengage the collar is less than the force required to remove the post from the sealing cap and less than the force required to uncouple the valve head from the post.

Unless defined otherwise, all technical and scientific terms used herein have the same meaning as commonly understood by one of ordinary skill in the art to which the present disclosure pertains.

It will also be appreciated that systems, devices, products, kits, methods, and/or processes, according to certain embodiments of the present disclosure may include, incorporate, or otherwise comprise properties, features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A biological sample collection system, comprising:

a sample collection vessel having an opening for receiving a biological sample;

a selectively movable valve configured to at least partially associate with the opening of the sample collection vessel, the selectively movable valve comprising:

a post having a hollow body and a fluid vent defined by a sidewall portion thereof; and a valve head associated with a distal portion of the post and having an aperture selectively alignable with the fluid vent;

wherein the fluid vent and the aperture are both substantially perpendicular to the longitudinal axis of the sample collection vessel and the post; and a sealing cap configured to associate with the selectively movable valve and with the sample collection vessel, the sealing cap comprising a reagent chamber for storing a measure of sample preservation reagent, the reagent chamber being in fluid communication with the hollow body of the post, wherein the fluid vent is obstructed by the valve head when the selectively movable valve is in a closed configuration, and wherein the fluid vent is at least partially aligned with the valve head when the selectively movable valve is in an open configuration, wherein associating the sealing cap with the sample collection vessel causes a physical rearrangement of the post and the valve head such that the fluid vent aligns with the aperture defined by the valve head, placing the selectively moveable valve in the open configuration and allowing fluid communication between the reagent chamber and the sample collection vessel.

2. The biological sample collection system as in claim 1, wherein the physical rearrangement comprises a rotational rearrangement of the post relative to the valve head.

3. The biological sample collection system as in claim 2, wherein the sample collection vessel further comprises a connection member, and wherein the sealing cap further comprises a complementary connection member configured to associate with the connection member of the sample collection vessel to couple the sample collection vessel and the sealing cap.

4. The biological sample collection system as in claim 3, wherein the connection member comprises a ridge projecting away from the sample collection vessel or a depression within the sample collection vessel and the complementary connection member comprises a hook or ridge sized and shaped to engage the connection member.

5. The biological sample collection system as in claim 3, wherein the connection member and the complementary connection member comprise threads.

6. The biological sample collection system as in claim 5, wherein the threads of the complementary connection member are disposed on an inner surface of the sealing cap.

7. The biological sample collection system as in claim 1, wherein the sample collection system comprises a separable two-piece sample collection system, the sample collection vessel comprising a first piece of the separable two-piece sample collection system, and the selectively movable valve associated with the sealing cap comprising a second piece of the separable two-piece sample collection system.

8. The biological sample collection system as in claim 1, wherein the post comprises a retaining ring configured to associate with a protrusion or detent within an interior portion of the sealing cap.

9. The biological sample collection system as in claim 1, wherein one or more of the post or the valve head comprises an annular retention element configured to maintain a tight association between the post and valve head.

10. The biological sample collection system as in claim 1, wherein the valve head comprises an upper collar disposed proximal of the sidewall portion defining the fluid vent, the upper collar having a greater diameter than the sidewall portion defining the fluid vent and configured to interface with an interior sidewall of the sample collection vessel.

11. The biological sample collection system as in claim 10, wherein a sealing force between the valve head and the post is less than a gripping force between the upper collar of the valve head and an interior sidewall of the sample collection vessel.

12. A method for collecting and preserving a biological sample, comprising:

receiving a biological sample in a sample collection chamber of the sample collection vessel of the sample collection system of claim 1; and associating the sealing cap of the sample collection system of claim 1 with the sample collection vessel to place the selectively movable valve associated with the sealing cap in the open configuration, thereby releasing sample preservation reagent held within reagent compartment of the sealing cap into the sample collection chamber of the sample collection vessel.

13. The method as in claim 12, wherein receiving the sample at the sample collection vessel comprises receiving the biological sample through an opening of a sample collection chamber within the sample collection vessel directly or through an associated funnel.

14. The method as in claim 13, wherein associating the sealing cap with the sample collection vessel comprises threadedly engaging a connection member disposed on an exterior surface of the sample collection vessel with a complementary connection member disposed on an interior surface of the sealing cap.

15. The method as in claim 14, wherein associating the sealing cap with the sample collection vessel to cause the selectively movable valve associated with the sealing cap to open comprises rotating the post within the associated valve head to at least partially align the fluid vent of the post with the aperture defined by the valve head.

16. The method as in claim 12, further comprising accessing a preserved sample within the sample collection vessel by disassociating the sealing cap from the sample collection vessel, wherein disassociating the sealing cap from the sample collection vessel causes the selectively movable valve associated with the sealing cap to move from an open configuration to a closed configuration.

17. A kit for collecting and preserving a biological sample, comprising:

a sample collection vessel, comprising:

a sample collection chamber having an opening configured to receive the biological sample into the sample collection chamber; and a connection member disposed on an exterior portion the sample collection vessel;

a sealing cap, comprising:

a reagent chamber storing a measure of sample preservation reagent; and a complementary connection member configured to engage the connection member of the sample collection vessel; and a selectively movable valve coupled to the sealing cap, the selectively movable valve configured to associate with the sample collection chamber and comprising:

a post defining a fluid vent at a distal portion thereof; and a valve head associated with the distal portion of the post, the valve head defining an aperture, wherein the fluid vent and the aperture are both substantially perpendicular to the longitudinal axis of the sample collection vessel and the post, wherein when the selectively movable valve is in a closed configuration, the fluid vent forms a fluid-tight association with the valve head, and wherein when the selectively movable valve is in an open configuration, the fluid vent is at least partially aligned with the aperture.

18. The kit as in claim 17, further comprising a funnel configured to associate with the sample collection vessel and to guide receipt of a biological sample from a user into the sample collection chamber of the sample collection vessel.

19. A biological sample collection system, comprising:

a sample collection vessel comprising a sample collection chamber having an opening to receive a biological sample into the sample collection chamber;

a sealing cap comprising a reagent chamber having sample preservation reagent stored therein and configured to associate with the sample collection vessel; and a selectively movable valve associated with the sealing cap and configured to move between a closed configuration and an open configuration, the selectively movable valve comprising:

a post in fluid communication with the reagent chamber of the sealing cap, the post having a fluid vent defined by a distal sidewall portion thereof, the fluid vent being transverse to the longitudinal axis of the sealing cap; and a valve head surrounding the distal sidewall portion of the post, the valve head defining an aperture sized and shaped to receive the fluid vent and comprising an upper collar proximal to the aperture that is sized and shaped to engage an interior sidewall of the sample collection chamber, wherein the fluid vent and the aperture are both substantially perpendicular to the longitudinal axis of the sample collection vessel and the post, wherein the fluid vent forms a fluid-tight association with the valve head in the closed configuration, and wherein the post is operable to move relative to the valve head to configure the selectively movable between the closed configuration and the open configuration.

20. A biological sample collection system, comprising:

a sample collection vessel having an opening for receiving a biological sample;

a selectively movable valve configured to at least partially associate with the opening of the sample collection vessel, the selectively movable valve comprising:

a post having a hollow body and a fluid vent defined by a sidewall portion thereof; and a valve head associated with a distal portion of the post and having an aperture selectively alignable with the fluid vent;

wherein the fluid vent and the aperture are both substantially perpendicular to the longitudinal axis of the sample collection vessel and the post; and a sealing cap configured to associate with the selectively movable valve and with the sample collection vessel, the sealing cap comprising a reagent chamber for storing a measure of sample preservation reagent, the reagent chamber being in fluid communication with the hollow body of the post, wherein associating the sealing cap with the sample collection vessel causes a rotational rearrangement of the post relative to the valve head such that the fluid vent aligns with the aperture defined by the valve head, allowing fluid communication between the reagent chamber and the sample collection vessel.

21. A biological sample collection system, comprising:

a sample collection vessel having an opening for receiving a biological sample;

a selectively movable valve configured to at least partially associate with the opening of the sample collection vessel, the selectively movable valve comprising:

a post having a hollow body and a fluid vent defined by a sidewall portion thereof; and a valve head associated with a distal portion of the post and having an aperture selectively alignable with the fluid vent;

wherein the fluid vent and the aperture are both substantially perpendicular to the longitudinal axis of the sample collection vessel and the post; and a sealing cap configured to associate with the selectively movable valve and with the sample collection vessel, the sealing cap comprising a reagent chamber for storing a measure of sample preservation reagent, the reagent chamber being in fluid communication with the hollow body of the post, wherein the sample collection system comprises a separable two-piece sample collection system, the sample collection vessel comprising a first piece of the separable two-piece sample collection system, and the selectively movable valve associated with the sealing cap comprising a second piece of the separable two-piece sample collection system, wherein associating the sealing cap with the sample collection vessel causes a rotational rearrangement of the post relative to the valve head such that the fluid vent aligns with the aperture defined by the valve head, allowing fluid communication between the reagent chamber and the sample collection vessel.

22. A biological sample collection system, comprising:

a sample collection vessel having an opening for receiving a biological sample;

a selectively movable valve configured to at least partially associate with the opening of the sample collection vessel, the selectively movable valve comprising:

a post having a hollow body and a fluid vent defined by a sidewall portion thereof; and a valve head associated with a distal portion of the post and having an aperture selectively alignable with the fluid vent;

wherein the fluid vent and the aperture are both substantially perpendicular to the longitudinal axis of the sample collection vessel and the post, a sealing cap configured to associate with the selectively movable valve and with the sample collection vessel, the sealing cap comprising a reagent chamber for storing a measure of sample preservation reagent, the reagent chamber being in fluid communication with the hollow body of the post; and a funnel configured to associate with the sample collection vessel and to guide receipt of a biological sample from a user into the sample collection chamber of the sample collection vessel, wherein associating the sealing cap with the sample collection vessel causes a rotational rearrangement of the post relative to the valve head such that the fluid vent aligns with the aperture defined by the valve head, allowing fluid communication between the reagent chamber and the sample collection vessel.

* * * * *